US008539641B2

(12) United States Patent
Bartholomew

(10) Patent No.: US 8,539,641 B2
(45) Date of Patent: Sep. 24, 2013

(54) DOOR STOP FOR SLIDING DOORS

(75) Inventor: Glenn W. Bartholomew, Havre De Grace, MD (US)

(73) Assignee: Glenn Bartholomew, Havre De Grace, MD (US)

( * ) Notice: Subject to any disclaimer, the term of this patent is extended or adjusted under 35 U.S.C. 154(b) by 60 days.

(21) Appl. No.: 13/431,930

(22) Filed: Mar. 27, 2012

(65) Prior Publication Data

US 2012/0246870 A1 Oct. 4, 2012

Related U.S. Application Data

(60) Provisional application No. 61/468,839, filed on Mar. 29, 2011.

(51) Int. Cl.
*E05F 5/02* (2006.01)

(52) U.S. Cl.
USPC ..... 16/82; 16/404

(58) Field of Classification Search
USPC ..... 16/71, 82, DIG. 17, DIG. 20, DIG. 21, 16/DIG. 41, 404
See application file for complete search history.

(56) References Cited

U.S. PATENT DOCUMENTS

| | | | | |
|---|---|---|---|---|
| 2,496,691 | A * | 2/1950 | Berry | 292/251.5 |
| 2,885,237 | A * | 5/1959 | Heyer | 292/70 |
| 3,086,803 | A * | 4/1963 | Wilson | 292/17 |
| 3,239,261 | A * | 3/1966 | Bryson et al. | 292/75 |
| 3,243,836 | A * | 4/1966 | Reiss | 16/85 |
| 6,629,335 | B1 * | 10/2003 | Derman | 16/85 |
| 7,226,091 | B2 * | 6/2007 | Amy | 292/100 |

* cited by examiner

*Primary Examiner* — Roberta Delisle

(57) ABSTRACT

A door stop for a sliding door includes rounded channel with a ball sliding into the rounded channel to hold a sliding door in place. The device of the present invention is smaller than conventional devices and, thus, minimize the hazard to horses getting lacerations from the larger sized conventional door holders. The device of the present invention is provided as a two-piece kit, the first piece fitting on the siding door and the second piece fitting on a wall, such that the first and second pieces fit together when the sliding door is closed, holding and/or stopping the door in place.

10 Claims, 2 Drawing Sheets

DOOR STOP FOR SLIDING DOORS

CROSS-REFERENCE TO RELATED APPLICATIONS

This application claims the benefit of priority of U.S. provisional patent application No. 61/468,839, filed Mar. 28, 2011, the contents of which are herein incorporated by reference.

BACKGROUND OF THE INVENTION

The present invention relates to door stops and, more particularly, to a rounded channel with a ball sliding into the rounded channel to hold a sliding door in place when closed.

Current sliding door stops stick out about 4 inches from the wall into the isle when sharp edges. They are hazards to horses in the isles. Legs could be caught in these edges, resulting in lacerations.

As can be seen, there is a need for an improved door stop for a sliding door so that the door will not swing or be pushed back and forth.

SUMMARY OF THE INVENTION

In one aspect of the present invention, a door stop for a sliding door comprises a ball member having a ball formed on one end thereof; and a channel member having a channel formed on one side thereof, wherein the ball of the ball member is adapted to fit into the channel of the channel member when the sliding door is closed.

In another aspect of the present invention, a method for keeping a sliding door closed comprises attaching a ball member, having a ball formed on one end thereof, to a sliding door; attaching a channel member, having a channel formed on one side thereof, to a wall adjacent to the sliding door; and closing the sliding door to cause the ball of the ball member to fit into the channel of the channel member to keep the sliding door closed.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a rounded channel with a ball sliding into the rounded channel to hold a sliding door in place. The device of the present invention is smaller than conventional devices and, thus, minimize the hazard to horses getting lacerations from the larger sized conventional door holders. The device of the present invention is provided as a two-piece kit, the first piece fitting on the siding door and the second piece fitting on a wall, such that the first and second pieces fit together when the sliding door is closed, holding and/or stopping the door in place.

Figure 1:
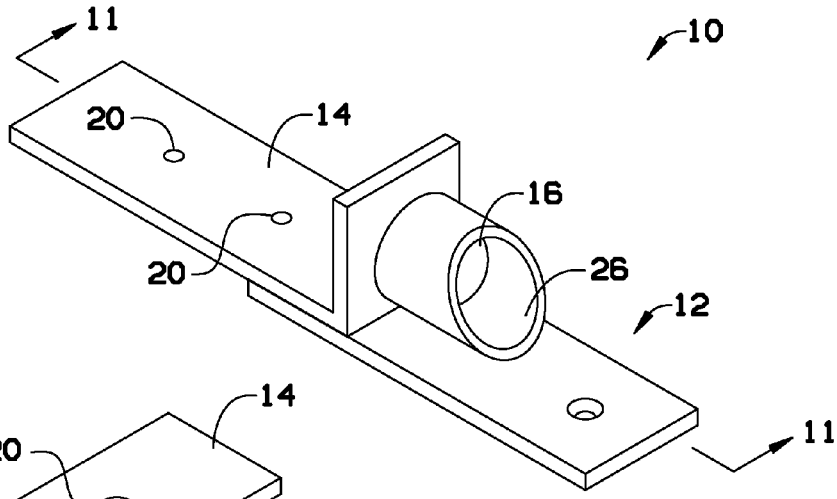
FIG. 1 is a perspective view of a door stop for sliding doors according to an exemplary embodiment of the present invention.
Figure 2:
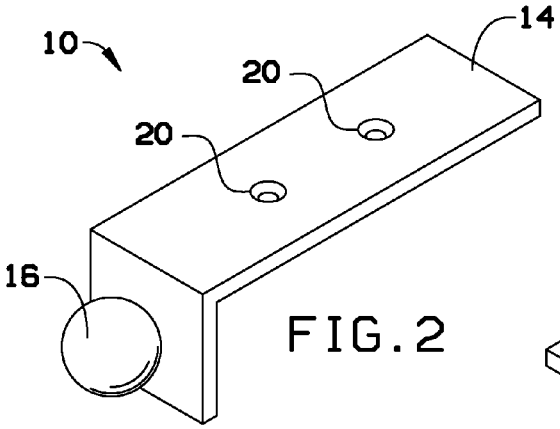
FIG. 2 is a bottom perspective view of a ball element of the door stop for sliding doors of FIG. 1.
Figure 3:
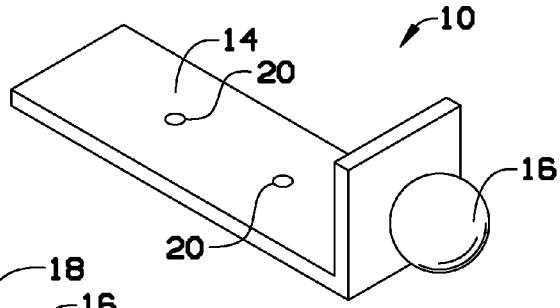
FIG. 3 is a top perspective view of the ball element of the door stop for sliding doors of FIG. 1.
Figure 4:
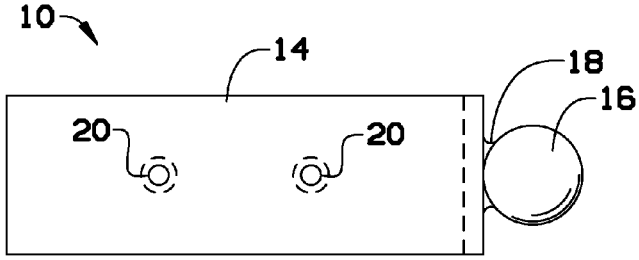
FIG. 4 is a bottom view of the ball element of the door stop of FIG. 1.
Figure 5:
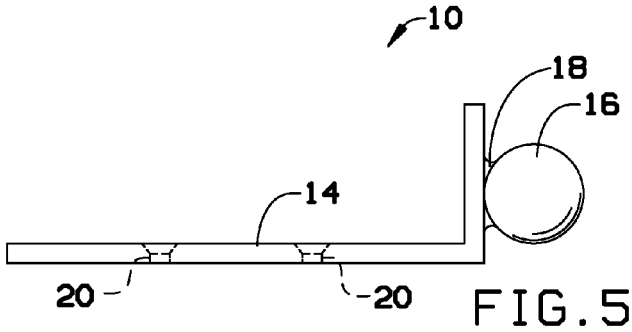
FIG. 5 is a side view of the ball element of the door stop of FIG. 1.
Figure 6:
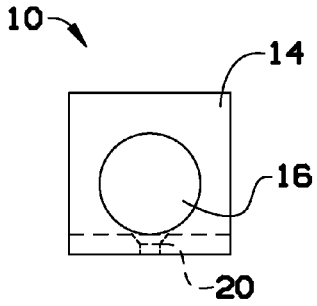
FIG. 6 is an end view of the ball element of the door stop of FIG. 1.
Figure 7:
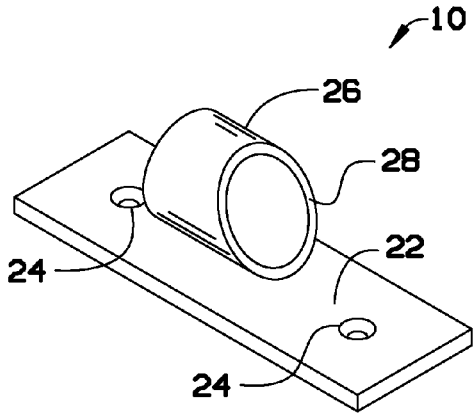
FIG. 7 is a top perspective view of a pipe element of the door stop of FIG. 1.
Figure 8:
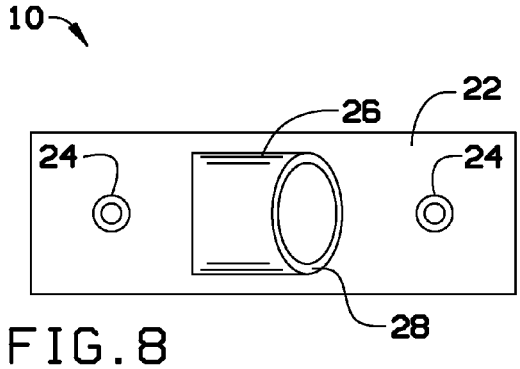
FIG. 8 is a top view of the pipe element of the door stop of FIG. 1.
Figure 9:
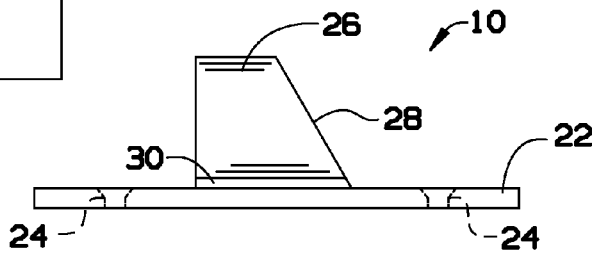
FIG. 9 is a side view of the pipe element of the door stop of FIG. 1.
Figure 10:
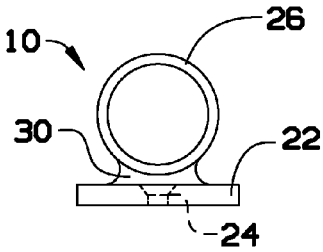
FIG. 10 is an end view of the pipe element of the door stop of FIG. 1.
Figure 11:
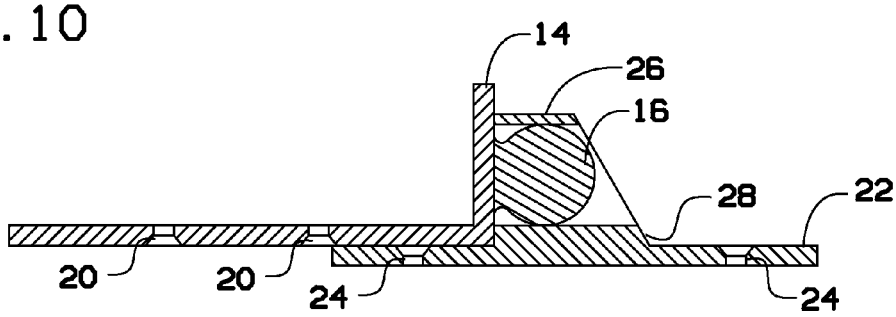
FIG. 11 is a cross sectional view taken along line 11-11 of FIG. 1

Referring now to FIGS. 1 through 11, a door stop assembly may include a ball member 10 and a channel member 12. The ball member 10 may include a ball 16 attached to an angled member 14. Typically, the angled member 14 forms a 90 degree angle in an L-shape. The ball 16 may be attached to a shorter end of the L-shaped angled member 14. The ball 16 may be attached by welding 18, adhesive, of the like. In some embodiments, the ball 16 may be formed as an integral piece with the angled member 14 during manufacturing.

Typically, the ball member 10 is made from metal, such as steel, stainless steel, aluminum, or the like. However, the ball member 10 may also be made from one or more other materials, such as plastic, composite, wood, or the like.

The ball member 10 may include one or more holes 20. Typically two holes 20 are formed along the long end of the L-shaped angled member 14. The holes 20 may be counter-sunk holes such that a screw can be flush with the angled member 14 when holding the ball member 10 in place.

The channel member 12 may include a generally flat plate 22 having a channel 26 attached to one face thereof. The channel 26 may be a round channel, such as a pipe. The pipe may be attached to the flat plate 22 by, for example, welding 30, adhesive, or the like. In some embodiments, the pipe may be formed integrally with the flat plate 22 during a manufacturing process. The channel 26 may have one edge 28 cut at an angle, typically from about 10 to about 45 degrees from perpendicular.

Typically, the channel member 12 is made from metal, such as steel, stainless steel, aluminum, or the like. However, the channel member 12 may also be made from one or more other materials, such as plastic, composite, wood, or the like.

The channel member 12 may include one or more holes 24. Typically two holes 24 are formed along the flat plate 22 of the channel member 12. The holes 24 may be counter-sunk holes such that a screw can be flush with the flat plate 22 when holding the channel member 12 in place.

As shown in the Figures, the ball member 10 may include the round ball 16. The shape of the ball, however, may be changed within the scope of the present invention, provided that the ball, regardless of shape, fits into the channel 26. Similarly, the channel 26 may typically be round, however, other shapes may be included within the scope of the present invention, provided that the channel 26 accepts the ball 16 therewithin.

The ball member 10 may typically be attached to a sliding door, while the channel member 12 may typically be attached to a wall in a position to accept the ball 16 of the ball member 10 when the sliding door is closed. This configuration may be reversed within the scope of the present invention.

The below describes one particular embodiment of the door stop of the present invention. The sizes described below are exemplary sizes and should not be considered as limiting the scope of the present invention as defined by the claims.

The sliding door stop of the present invention is made of two parts. The ball member 10 may be made from about ⅛" by about 1" flat steel with about a 1" ninety degree bend with about a ⅝" steel ball welded at the ninety degree bend end. Two ⅛" counter sunk holes, about 1" apart, may be formed in the center of the flat steel in the ball member 10 to fasten by two ⅛" screws to the sliding door. When the door closes the steel ball slides into the channel member 12 that is fastened to the wall.

The channel member 12 may be made of about ⅛" by about 1" flat, typically steel, about 3" long plus about 1" of ¾" pipe welded on the flat steel. Two countersunk ⅛" holes, about 1" apart, may be formed in the center of the flat steel in the channel member 12 to fasten by two ⅛" screws to the wall. The ball 16 of the ball member 10 can slide into the channel 26 of the channel member 12, holding and or stopping the door in place.

It should be understood, of course, that the foregoing relates to exemplary embodiments of the invention and that modifications may be made without departing from the spirit and scope of the invention as set forth in the following claims.

What is claimed is:

1. A door stop for a sliding door, comprising:

a ball member including a ball attached on one end of an angle member having at least one countersunk hole; and a channel member including a plate having at least one hole and a channel attached having a first end and a second end, the first end has a straight edge and the second end has an angled edge, wherein the ball of the ball member slides into the channel of the channel member when the sliding door is closed, holding or stopping a door in place.

2. The door stop of claim 1, wherein the ball member is adapted to attach to the sliding door and the channel member is adapted to attach to a wall adjacent to the sliding door.

3. The door stop of claim 1, wherein the angle member is an L-shaped plate having one side shorter than the other with the ball attached to the short side of the L-shaped plate.

4. The door stop of claim 1, wherein the channel is a pipe.

5. The door stop of claim 1, wherein the pipe is cut at an angle at one side thereof.

6. The door stop of claim 1, wherein the ball member has two counter-sunk holes formed therethrough.

7. The door stop of claim 2, wherein the channel member has two holes formed therethrough.

8. A method for keeping a sliding door closed, the method comprising:

attaching a ball member, having a ball attached on one end thereof, to a sliding door;

attaching a channel member, having a channel formed on one side thereof, to a wall adjacent to the sliding door; and closing the sliding door to cause the ball of the ball member to slide into the channel of the channel member to keep the sliding door closed, holding or stopping a door in place.

9. The method of claim 8, wherein an L-shaped plate having one side shorter than the other forms the ball member, with the ball attached to a short side of the L-shaped plate.

10. The method of claim 8, wherein the channel is a pipe.

* * * * *